US005088818A

United States Patent [19]

Nicholson

[11] Patent Number: 5,088,818

[45] Date of Patent: * Feb. 18, 1992

[54] OPTICAL AIMING DEVICE

[75] Inventor: Eric Nicholson, Bangor, Northern Ireland

[73] Assignee: Short Brothers plc, Belfast, Northern Ireland

[ * ] Notice: The portion of the term of this patent subsequent to Oct. 27, 2004 has been disclaimed.

[21] Appl. No.: 485,764

[22] Filed: Feb. 26, 1990

Related U.S. Application Data

[63] Continuation of Ser. No. 9,348, Jan. 30, 1987, abandoned.

[30] Foreign Application Priority Data

Feb. 3, 1986 [GB] United Kingdom ..... 8602605

[51] Int. Cl.[5] ..... G01C 15/14

[52] U.S. Cl. ..... 356/152; 356/153; 244/3.16; 244/3.13

[58] Field of Search ..... 356/152, 153; 244/3.13, 244/3.16

[56] References Cited

U.S. PATENT DOCUMENTS

| | | | |
|---|---|---|---|
| 3,752,587 | 8/1973 | Myers et al. | 356/153 |
| 4,100,404 | 7/1978 | Johnson et al. . | |
| 4,108,551 | 8/1978 | Weber | 356/152 X |
| 4,146,329 | 3/1979 | King et al. | 356/152 |
| 4,200,251 | 4/1980 | Börjesson et al. | 244/3.13 |
| 4,326,800 | 4/1982 | Fitts | 356/152 |
| 4,349,838 | 9/1982 | Daniel | 244/3.13 X |
| 4,385,834 | 5/1983 | Maxwell, Jr. | 356/152 X |
| 4,386,848 | 6/1983 | Clendenin et al. | 356/152 X |
| 4,393,597 | 7/1983 | Picard et al. . | |
| 4,422,758 | 12/1983 | Godfrey et al. | 356/152 |
| 4,621,924 | 11/1986 | Williams | 356/153 |
| 4,702,435 | 10/1987 | Montgomery et al. | 244/3.13 |

FOREIGN PATENT DOCUMENTS

| | | |
|---|---|---|
| 0197710 | 10/1986 | European Pat. Off. . |
| 2137062 | 12/1972 | France . |
| 1325162 | 8/1973 | United Kingdom . |
| 1553388 | 9/1979 | United Kingdom . |

*Primary Examiner*—Mark Hellner

*Attorney, Agent, or Firm*—Cushman, Darby & Cushman

[57] ABSTRACT

An optical aiming device comprising optical elements providing a primary optical path by which a field of view is presented to an observer and a secondary optical assembly providing two stabilized secondary optical paths for projecting a stabilized aiming mark into the field of view and for projecting from the device a stabilized optical aiming beam. The secondary optical assembly comprises a reflector by which the secondary optical paths are stabilized, the reflector being mounted in a gimbal for rotation about a first axis and the gimbal being mounted for rotation about a second axis perpendicular to the first axis, and the assembly further comprising stabilizing actuator means operative to move the reflector and the gimbal about the two axes of rotation to maintain the reflector stabilized against movement within predetermined limits of the device about the two axes.

13 Claims, 4 Drawing Sheets

OPTICAL AIMING DEVICE

This is a continuation of application Ser. No. 009,348, filed Jan. 30, 1987, which was abandoned upon the filing hereof.

The present invention relates to an optical aiming device and is particularly although not exclusively concerned with an optical aiming device for use in guiding a missile to a target.

In a man-portable guided missile system which has been proposed the missile is housed in a launcher and fired from the launcher by an operator who supports the launcher on his shoulder and steadies it using his arms. The operator tracks the target using an aiming unit provided on the launcher and the missile is guided to the target using any one of a variety of different guidance techniques. In one such technique the missile is guided to the target under the control of a laser beam generated by the aiming unit and directed to the target by the operator when tracking the target with the aiming unit. It has been found that while the operator can usually hold the target within the field of view of the aiming unit and bring the missile laser guidance beam on to the target erratic small pitching and yawing movements of the launcher by the operator give rise to unnecessary deflections of the guidance beam.

It is one object of the present invention to provide an optical aiming device which projects an aiming beam and which provides means for stabilisation of the aiming beam against erratic movements of the device within predetermined limits, It is another object of the present invention to provide in an optical aiming device means for projection into the field of view of an aiming mark stabilised against erratic movements of the device within predetermined limits.

It is yet another object of the present invention to provide an optical aiming device which can be used as an aiming unit in the missile system above referred to and which provides for stabilisation of the guidance beam against erratic movements of the launcher and the aiming device provided with it.

It is still yet another object of the present invention to provide an optical aiming device which can be used as the aiming unit in the missile system above referred to, which provides for stabilisation of the guidance beam against erratic movements of the launcher and the aiming device provided with it and in which an aiming mark can be projected into the field of view of the operator to represent the guidance beam, the aiming mark being stabilised in the same manner as the guidance beam.

According to the present invention there is provided an optical aiming device comprising optical elements providing a primary optical path by which a field of view is presented to an observer and a secondary optical assembly providing one or more stabilised secondary optical paths, the secondary optical assembly comprising a reflector by which the secondary optical path or paths are stabilised, the reflector being mounted in a gimbal for rotation about a first axis and the gimbal being mounted for rotation about a second axis perpendicular to the first axis, and the assembly further comprising stabilising actuator means operative to move the reflector and the gimbal about the two axes of rotation to maintain the reflector stabilised against movement within predetermined limits of the device about the two axes.

In embodiments of the invention hereinafter to be described the secondary optical assembly is so mounted that the first and second axes are pitch and yaw axes of the device and the stabilising actuator means comprises pitch and yaw stabilising actuators. Preferably, the gimbal carries the first actuator for rotating the reflector about the first axis and the gimbal is mounted in a housing of the device for rotation about the second axis under the control of the second actuator. Advantageously, the centre of inertia of the first actuator lies on the second axis.

The secondary optical assembly of the device according to the invention may simply provide a single stabilised secondary optical path for projecting a stabilised aiming mark into the field of view or a single stabilised secondary optical path for projecting from the device a stabilised optical aiming beam. In the embodiments of the invention hereinafter to be described the secondary optical assembly however provides a first stabilised secondary optical path for projecting a stabilised aiming mark into the field of view and a second stabilised secondary optical path for projecting from the device a stabilised optical aiming beam.

The secondary optical assembly in an embodiment of invention hereinafter to be described provides for the projection of the stabilised aiming mark and the aiming beam such that the position of the aiming mark in the field of view is representative of the disposition of the aiming beam and operator-controlled means are provided which are operative to bring the aiming mark in the field of view on to a target within the field of view, whereby the aiming beam is directed at the target.

In one embodiment of the invention hereinafter to be described the reflector comprises first and second reflector elements spaced from one another, the first reflector element serving to stabilise the first of the secondary optical paths and the second reflector element serving to stabilise the second of the secondary optical paths. Where the aiming beam is a laser beam a baffle is preferably positioned between the first and second reflector elements to prevent radiation of the laser beam in the second stabilised secondary optical path from entering the first stabilised secondary optical path provided for projection of the aiming mark into the field of view.

In a preferred embodiment of the invention, the baffle comprises a first web element mounted on the reflector between the first and second reflector elements and a second web element mounted on the gimbal in proximity to the first web element and wherein the web elements are so constructed as to provide a labyrinth gap between them preventing the transmission of laser beam radiation from one secondary optical path to the other.

In an alternative embodiment of the invention hereinafter to be described the reflector comprises a double-sided reflector at a first side of which the aiming mark is reflected into the field of view and stabilised and at a second side of which the aiming beam is reflected and stabilised.

Two embodiments of the invention will now be described by way of example with reference to the accompanying drawings in which.

Figure 1:
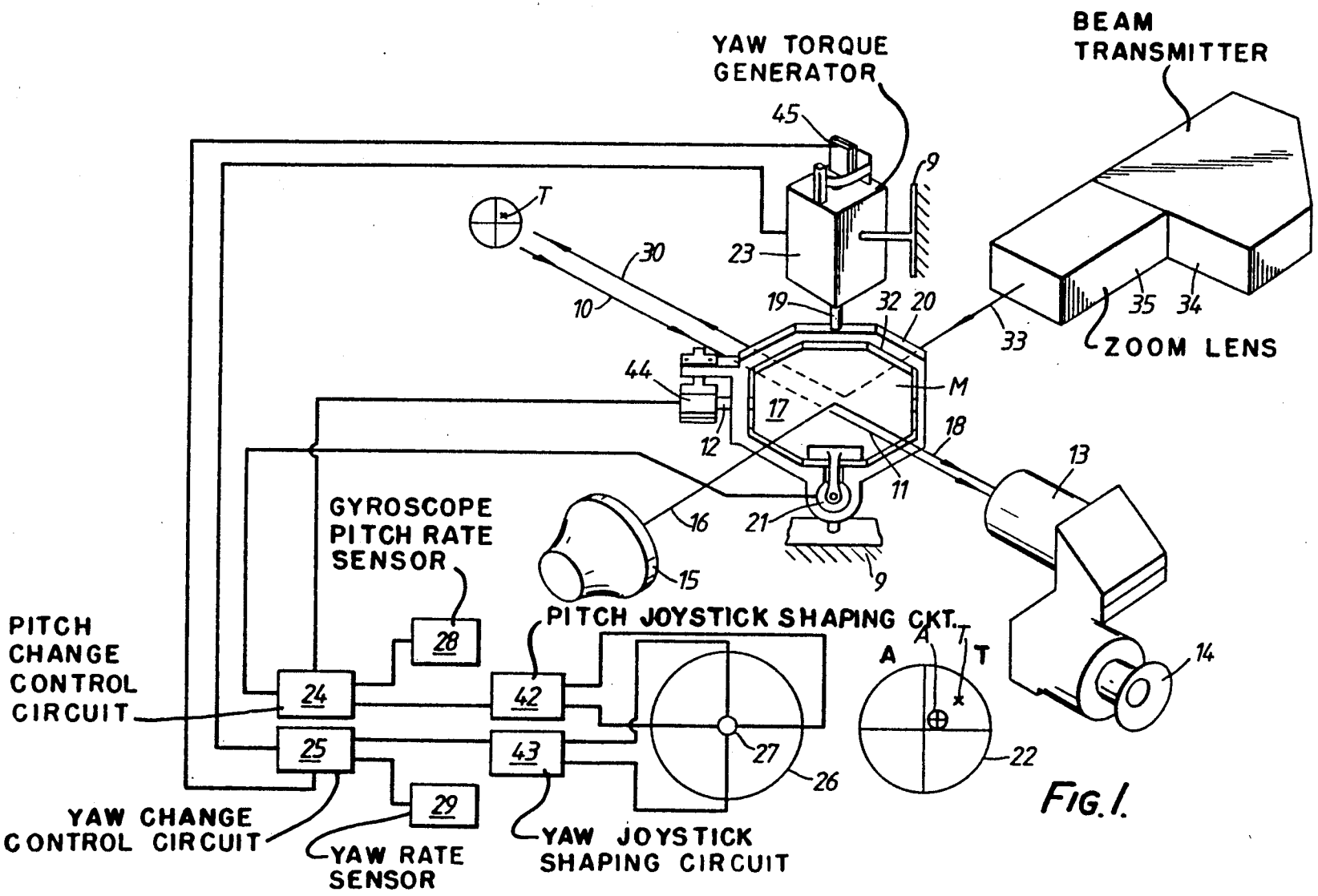
FIG. 1 is a schematic isometric diagram of an optical aiming device according to a first embodiment of the invention, showing first optical elements providing a primary optical path and a secondary optical assembly providing two stabilised secondary optical paths.

Referring first to FIG. 1, an optical aiming device is shown in which radiation 10 from a target T passes through a dichroic mirror M along a primary optical path 11 to a monocular sight 13 with an eye piece 14 at which an operator is presented with an image of the target within a field of view. The dichroic mirror M forms part of a secondary optical assembly providing two stabilised secondary optical paths. The mirror M is pivotably mounted on a shaft 12 which is itself carried in a gimbal 20. The gimbal 20 is pivotably mounted on a shaft 19, and the axes of both of the shafts 12 and 19 pass through the axis of path 11.

A pitch solenoid actuator 21 carried on the gimbal 20 and with its moving armature coupled to the mirror M can be actuated to cause the mirror M to rotate within the gimbal 20 to any required angle within an angular range of about 5°. A yaw torque generator 23, mounted within the housing 9 of the apparatus and with its shaft coupled to the shaft 19, can be actuated to cause the gimbal 20 to rotate within the housing. The pitch solenoid actuator 21 is positioned such that the axis of the yaw torque generator 23 passes through the centre of the solenoid actuator mass 21 thus keeping to a minimum the yaw inertia to which the yaw torque generator 23 is subject.

An aiming mark injector 15 which comprises a lens system with an LED (light emitting diode) array in the focal plane projects a beam 16 of visible light defining an aiming mark A onto the mirror surface 17 of the stabilised mirror M. The resulting stabilised reflected beam 18 enters the monocular sight 13 and eye piece 14 and appears in the operator's field of view 22 seen at the eyepiece 14. Not shown is any filter in front of the sight 13, but it may be desirable in certain circumstances to provide one.

The pitch change actuator 21 is actuated by a pitch change control circuit 24 and the yaw torque generator 23 by a yaw change control circuit 25. The pitch control circuit 24 receives an input signal from a gyroscopic pitch rate sensor 28 and the yaw control circuit 25 from a gyroscope yaw rate sensor 29, which generate rate signals indicative of movement of the housing of the apparatus in pitch and yaw respectively. The shaft 12 carries a strain gauge pick-off 44 for feeding back pitch position data to the control circuit 24 and the shaft 19 carries a similar pick-off 45 for the control circuit 25. The control circuit 24 delivers a pitch stabilising signal to the solenoid actuator 21 for rotating the shaft 12 such as to stabilise the aiming mark in pitch. Similarly, a yaw stabilising signal is delivered to the yaw torque generator 23 for rotating the shaft 19 such as to stabilise the aiming mark in yaw. Thus, in whatever manner the housing 9 of the device is moved within small predetermined limits in pitch and yaw, the projected position of the aiming mark in space should remain constant.

The aiming device in the embodiments of the invention described herein is employed as an aiming device of a missile launcher and used to track the target T. For this purpose, the operator is provided with a joystick tracking means 26 with a thumb-operated joystick 27 for generating rate signals in pitch and yaw which actuate the torque generator 23 and the solenoid actuator 21 appropriate to move the aiming mark within the field of view, as required for tracking the target. The joystick 27 moves the aiming mark A within the field of view 22 in the eyepiece 14 by generating a simple yaw tracking signal and pitch tracking signal. These signals pass to joystick shaping circuitry 42 and 43 which modify the simple joystick outputs in pitch and yaw respectively to optimise tracking accuracy by the use of non-linear shaping and a variable gain profile. The non-linear shaping gives reduced response to small joystick movements in the centre of the field of view and the variable gain profile gives a decreasing response to the pitch and yaw joystick demands with increasing time from initiation of tracking, i.e. with increasing range of the missile from the tracking device. Typically the decreasing gain profile ramp is started by a "ramp enable" signal generated a short time, e.g. four seconds, after the commencement of flight of a missile from the launcher.

A guidance beam 33 of laser radiation (e.g. an x-y scanning beam) is generated in a beam transmitter 34, passes through a zoom lens 35 and is reflected at the surface 32 of the dichroic mirror M. The stabilised reflected beam 30 is projected out from the aiming device towards the target. The guidance beam 33 is coincident with the aiming mark so that, provided the operator is capable of manipulating the joystick 27 to bring the aiming mark A into coincidence with the target T, the reflected guidance beam 30 will be centred on the target T.

Figure 2:
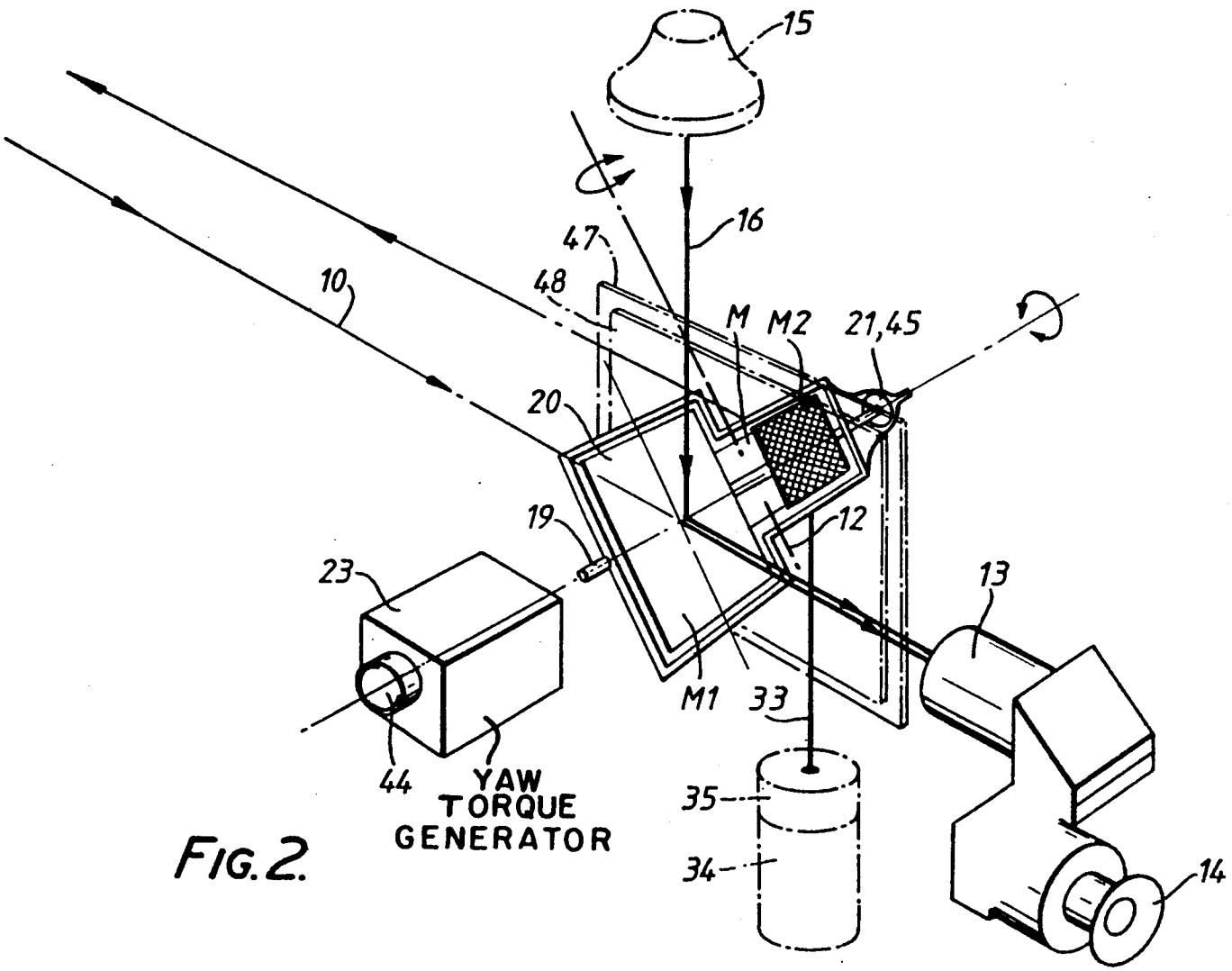
FIG. 2 is a similar diagram of an optical aiming device according to a second embodiment.
Figure 3:
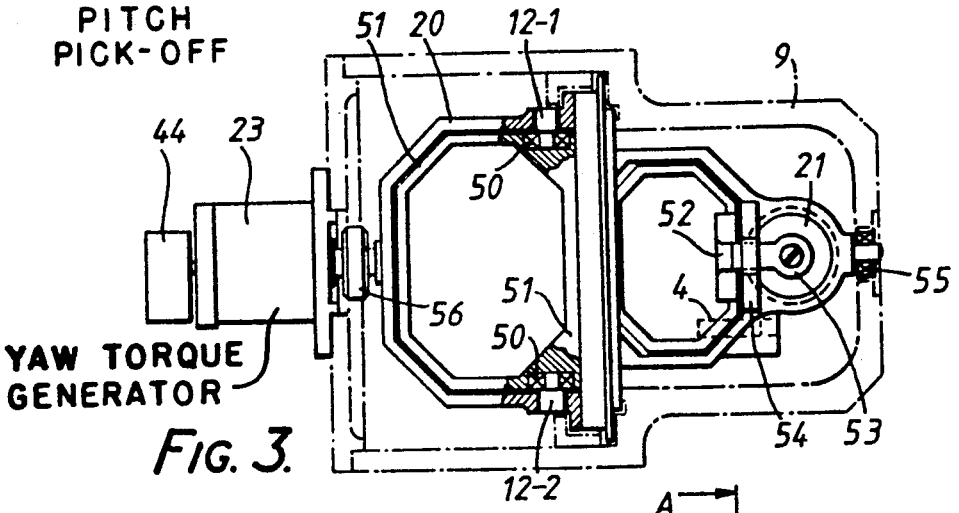
FIG. 3 is a plan view of the secondary optical assembly shown in FIG. 2, and is shown partly in section.
Figure 5:
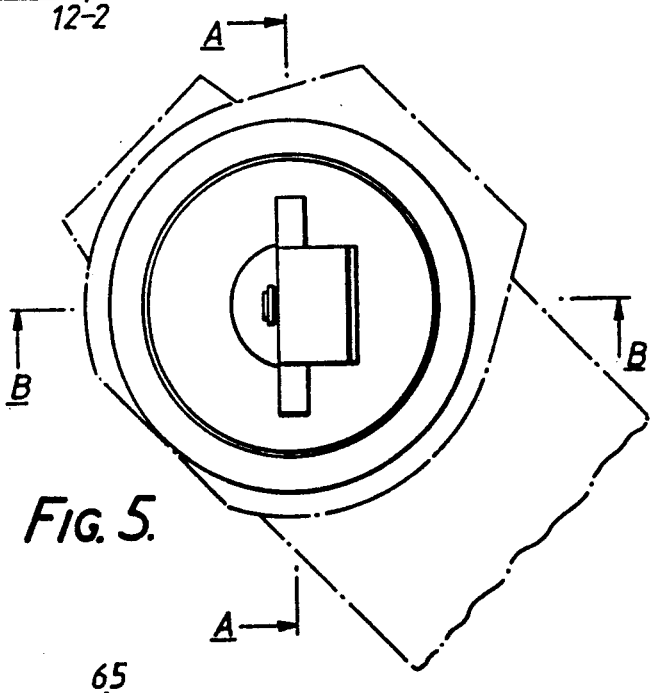
FIG. 5 is an end elevation of the assembly shown in FIG. 3.
Figure 4:
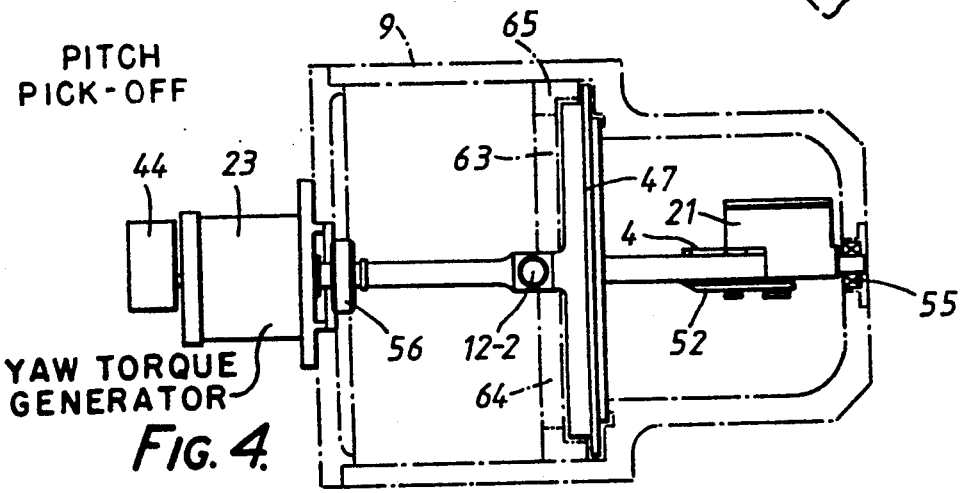
FIG. 4 is a side elevation of the assembly shown in FIG. 3.

The embodiment of FIG. 2 is similar, and like references are used to identify components which correspond. It should be noted that the gimbal rotates about a horizontal axis 19 for pitch stabilisation, rather than yaw.

The moving mirror unit M within the gimbal 20 comprises a dichroic mirror element Ml, and a mirror element M2 which is fully reflective on one side. The unit M pivots about shaft 12 located between the two mirror elements M1 and M2.

The laser source 34 is arranged so that the laser beam 33 is reflected at the mirror M2, whereas the radiation from the target 10, and that 16 from the aiming mark injector 15, is incident on element M1 for onward travel to the eyepiece 14.

The mirror unit M is stabilised and operated by joystick as in FIG. 1. The pick-off 45 for yaw stabilisation is mounted next to the solenoid yaw actuator 21 instead of on the shaft 12.

A pair of generally planar webs (which act as baffles or safety diaphragms) 47 and 48 are provided, for preventing any accidental travel of laser radiation to the mirror element M1 and thence to the eyepiece 14.

One web 47 is mounted on the gimbal 20 and the other web 48 on the moving mirror unit M. The plane of each of these webs lies close, and parallel, to the shaft 12, and a reasonable gap is provided between them, so that the mirror M can pivot through at least a limited angle (say, up to 5° ) about the shaft 12 without any contact between the two webs. In FIG. 2, the webs are indicated only schematically, and in phantom lines, for the sake of clarity.

FIG. 3 to 7 show in more detail the construction of the mirror assembly of FIG. 2.

The gimbal 20 carries two stub shafts 12-1 and 12-2, each carried in a bearing 50 in a mirror frame 51. The mirror frame 51 includes an arm 52 itself fixed to the moving armature 53 of the yaw actuator 21. A stop 54 is provided on the gimbal 20 to limit outward travel of the armature. The frame 51 pivots in the gimbal 20. The gimbal 20 is held by a clamp 56 to the shaft of the pitch torque generator 23. The gimbal 20 pivots with the pitch torque generator shaft and is supported by a tail end bearing 55 in the housing 9.

Figure 6:
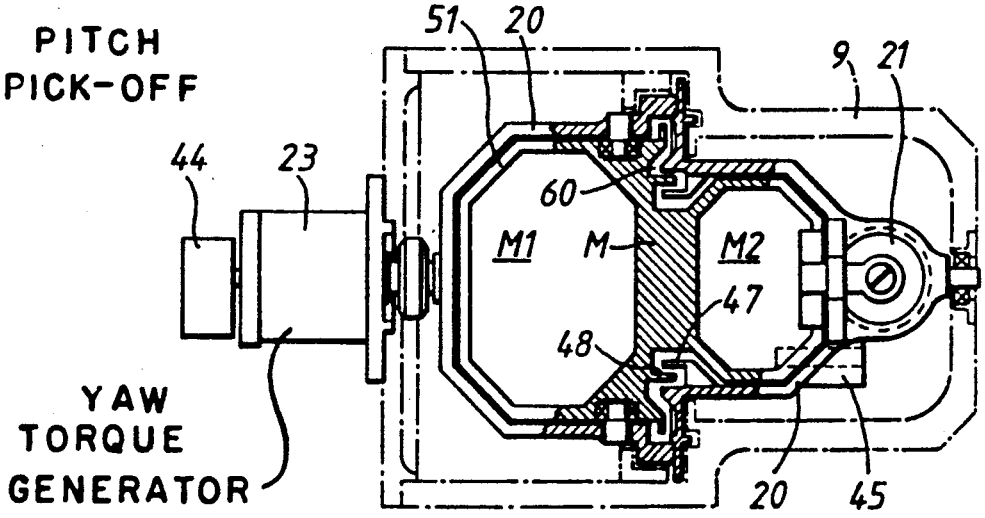
FIG. 6 is a section of the assembly shown in FIG. 3, taken on the like A—A in FIG. 5.

FIG. 6 shows the labyrinth gap 60 between the one web 48 of the moving mirror frame 51 and the other web 47 mounted to the gimbal 20. The strain gauge yaw pick-off 45 and pitch pick-off 44 should also be mentioned.

Figure 7:
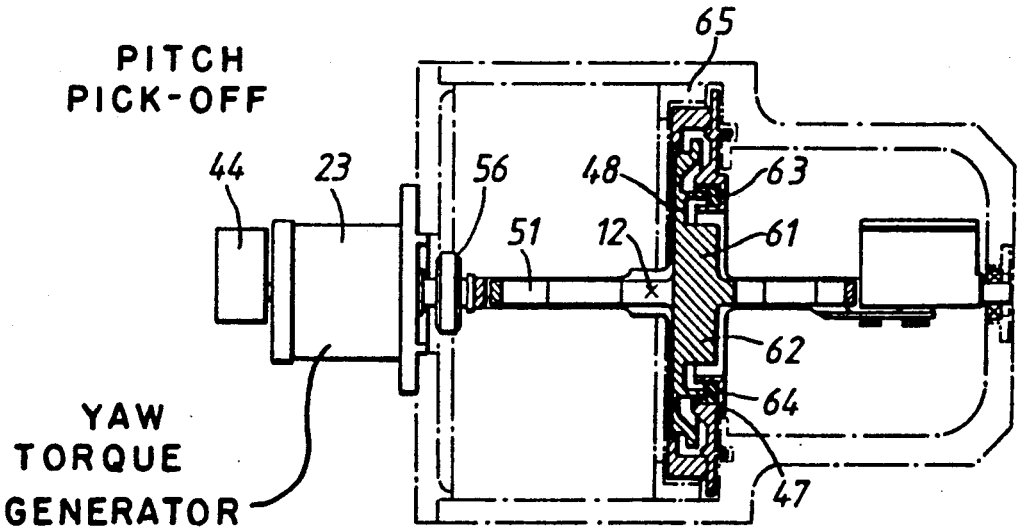
FIG. 7 is a section on the line B—B in FIG. 5.

FIG. 7 shows that the web 48 is formed as a unitary portion of the mirror frame 51, to define wall portions 61 and 62 which extend transverse to the surfaces of the mirrors M1 and M2 near the pivotal axis 12 and terminate in labyrinth seals 63 and 64 with the adjacent annular web 47.

To ensure safety between the mirror frame 51 and the gimbal 20 in the event of a failure occurring at the yaw pivots 12-1 and 12-2, the gimbal 20 is designed in two parts which are located and bolted together such as to trap the mirror unit M between them, to limit its movement to within angular constraints outside the normal working range of 5°. The centre web or diaphragm 47 of the gimbal 20 is in turn trapped with a limited amount of clearance around it between the housing 9 and a gimbal retaining ring 65.

In the event therefore of a total failure of the pitch and yaw pivots 19 and 12 the complete mirror assembly (20 and M) will still be retained in position, to resist any possibility of passage of laser radiation from the transmitter 34 to the eyepiece 14.

It is to be noted that the embodiment of FIGS. 2 to 7 differs from that of FIG. 1 in that the optical axis of each of the three beams 10,16 and 33 of radiation incident on the moving mirror unit M does not pass through the axis of pivotal movement about the shaft 12. Instead, there is an offset of about 2 or 3 cms. The pivotal movement is, however, small enough for this small offset not adversely to affect the efficiency of stabilisation, especially when it is required for aiming a laser beam onto a target at a distance of, say, 2 or 3 kilometers.

I claim:

1. An optical aiming device comprising optical elements providing a primary optical path by which a field of view is presented to an observer and a secondary optical assembly providing at least one stabilized secondary optical path, the secondary optical assembly comprising a reflector which is partially transmissive and partially reflective for incident radiation and for stabilizing the secondary optical path, the reflector being mounted in a gimbal for rotation about a first axis and the gimbal being mounted for rotation about a second axis perpendicular to the first axis, means for generating a guidance beam so as to be incident on said reflector and from said reflector onto a target along said secondary optical path, said primary optical path passing through said reflector and the assembly further comprising stabilizing actuator means operative to move the reflector and the gimbal about the two axes of rotation to maintain the reflector stabilized against movement within predetermined limits of the device about the two axes.

2. A device according to claim 1, wherein the secondary optical assembly is so mounted that the first and second axes are pitch and yaw axes of the device and wherein the stabilising actuator mechanism comprises pitch and yaw stabilising actuators.

3. A device according to claim 2, wherein the gimbal carries the first actuator for rotating the reflector about the first axis and wherein the gimbal is mounted in a housing of the device for rotation about the second axis under the control of the second actuator.

4. A device according to claim 3, wherein the center of inertia of the first actuator lies on the second axis.

5. A device according to claim 1, wherein the secondary optical assembly provides a secondary optical path for projecting a stabilised aiming mark into the field of view.

6. A device according to claim 1, wherein the secondary optical assembly provides a secondary optical path for projecting from the device a stabilised optical aiming beam.

7. A device according to claim 1, wherein the secondary optical assembly provides a first stabilised secondary optical path for projecting a stabilised aiming mark into the field of view and a second stabilised secondary optical path for projecting from the device a stabilised optical aiming beam.

8. A device according to claim 7, wherein the reflector unit comprises first and second reflector elements spaced from one another, the first reflector element serving to stabilise the first of the secondary optical paths and the second reflector element serving to stabilise the second of the secondary optical paths.

9. A device according to claim 8, wherein beam generating apparatus is provided for generating a laser aiming beam and wherein a baffle is positioned between the first and second reflector elements to prevent radiation of the laser beam in the second stabilised secondary optical path from entering the first stabilised secondary optical path provided for projection of the aiming mark into the field of view.

10. A device according to claim 9, wherein the baffle comprises a first web element mounted on the reflector between the first and second reflector elements and a second web element mounted on the gimbal in proximity to the first web element and wherein the web elements are so constructed as to provide a labyrinth gap between them preventing the transmission of laser beam radiation from one secondary optical path to the other.

11. A device according to claim 7, wherein the reflector comprises a double-sided reflector at a first side of which the aiming mark is reflected into the field of view and stabilised and at a second side of which the aiming beam is reflected and stabilised.

12. A device according to claim 7 wherein the secondary optical assembly provides for the projection of the stabilised aiming mark and the aiming beam such that the position of the aiming mark in the field of view is representative of the disposition of the aiming beam.

13. A device according to claim 12 comprising operator-controlled means to bring the aiming mark in the field of view on to a target within the field of view, whereby the aiming beam is directed at the target.

* * * * *